US005335517A

United States Patent [19]

Throneburg et al.

[11] Patent Number: 5,335,517

[45] Date of Patent: Aug. 9, 1994

[54] ANATOMICAL ISOTONIC SOCK AND METHOD OF KNITTING THE SAME

[75] Inventors: James L. Throneburg, 625 West Bell St., Statesville, N.C. 28677; George L. Thorneburg, Statesville, N.C.

[73] Assignee: James L. Throneburg, Statesville, N.C.

[21] Appl. No.: 96,708

[22] Filed: Jul. 23, 1993

[51] Int. Cl.[5] ..... D04B 1/02; D04B 1/26; A41B 11/02

[52] U.S. Cl. ..... 66/185; 66/194; 66/49; 2/239

[58] Field of Search ..... 66/49, 178 R, 182, 183, 66/184, 185, 186, 187, 194, 196, 197; 2/239, 241

[56] References Cited

U.S. PATENT DOCUMENTS

| | | | |
|---|---|---|---|
| D. 208,850 | 10/1967 | Thorneburg et al. | D2/330 |
| D. 271,348 | 11/1983 | Thorneburg | D2/331 |
| 2,144,563 | 1/1939 | Davis | 66/182 |
| 3,793,851 | 2/1974 | Thorneburg | 66/185 |
| 3,828,585 | 8/1974 | Thorneburg | 66/136 |
| 4,034,581 | 7/1977 | Swafford | 66/180 |
| 4,047,400 | 9/1977 | Thorneburg | 66/171 |
| 4,104,892 | 8/1978 | Thorneburg | 66/185 |
| 4,194,249 | 3/1980 | Thorneburg | 2/239 |
| 4,255,949 | 3/1981 | Thorneburg | 66/185 |
| 4,277,959 | 7/1981 | Thorneburg | 66/182 |
| 4,341,096 | 7/1982 | Safrit et al. | 66/196 X |
| 4,373,361 | 2/1983 | Thorneburg | 66/178 R |
| 4,422,307 | 12/1983 | Thorneburg | 66/172 E |
| 4,615,188 | 10/1986 | Hursh et al. | 66/196 |

FOREIGN PATENT DOCUMENTS

| | | | |
|---|---|---|---|
| 672544 | 2/1939 | Fed. Rep. of Germany | 66/194 |
| 1049041 | 1/1959 | Fed. Rep. of Germany | 66/194 |
| 0082452 | 5/1984 | Japan | 66/194 |
| 2140835 | 12/1984 | United Kingdom | 66/194 |

*Primary Examiner*—Clifford D. Crowder
*Assistant Examiner*—John J. Calvert
*Attorney, Agent, or Firm*—Bell, Seltzer, Park & Gibson

[57] ABSTRACT

The anatomical isotonic sock and method for knitting the sock provide enhanced protection and cushioning comfort to the foot of the wearer and is form-fitting and remains so after prolonged periods of use and numerous launderings. The sock has a knit foot and includes a relatively thick density of terry loops formed of at least three terry yarns in the ball and heel portions of the foot for supplementing and protecting the fatty pads so as to provide a therapeutic and preventative benefit to the foot of the wearer. A relatively thin density of terry loops formed of at least one terry yarn is knit in an arch portion and an instep portion of the foot and an intermediate density of terry loops formed of two terry yarns is knit in a toe portion. A stretchable body yarn is knit throughout the foot and cooperates with the terry loop yarn so as to maintain the terry loops in a substantially upstanding position thereby enhancing the cushioning characteristics of the terry loops in the sock over prolonged periods of use and numerous launderings.

25 Claims, 3 Drawing Sheets

ANATOMICAL ISOTONIC SOCK AND METHOD OF KNITTING THE SAME

FIELD OF THE INVENTION

This invention relates to a knit sock and, more particularly, to an anatomical isotonic sock which includes terry loops knit in selected portions and a stretchable body yarn knit throughout the portions of the foot of the sock having terry loops knit therein so as to provide enhanced protection and cushioning comfort for the foot of a wearer.

BACKGROUND OF THE INVENTION

Various proposed sock constructions disclose terry loops knit in portions of the foot of the sock to enhance cushioning, manage moisture, enhance blood circulation, and increase fabric density, particularly in the ball and heel portions thereof. For example, U.S. Pat. No. 2,144,563 by Davis entitled "*Stocking*" discloses a sock in which single terry loops are positioned beneath the foot. In the commonly assigned U.S. Pat. No. 4,194,249 by Thorneburg entitled "*Jogging And Running Athletic Sock*", the sock has double raised terry loops positioned in the heel and ball portions, and a single raised terry loop cushion in the arch. The commonly assigned U.S. Pat. No. 3,793,851 by Thorneburg entitled "*Boot Sock*", discloses a sock having double raised terry loops in the heel portion wherein single terry yarn is removed and cut at opposite sides of the heel portion.

Although the foregoing sock constructions disclose various socks with single and double raised terry loop construction, continued use of the sock and frequent launderings sometimes cause elongation of the sock and flattening of the terry loops so that the loops do not remain in an upstanding position substantially perpendicular to the body yarn of the sock. As a result, the density of the double raised terry loops is reduced, moisture control in the sock is minimized, greater shear forces are exerted between the wearer's foot and the sock, and the isotonic effect provided by enhanced cushioning pads is lessened. Thus, a wearer suffers because the sock cannot efficiently absorb impact, cannot effectively draw moisture away from the foot, and cannot effectively reduce the chance of foot ulcerations.

SUMMARY OF THE INVENTION

Therefore the present invention provides an anatomical isotonic sock constructed to enhance protection and comfort and resist elongation over many wearings and launderings. The sock has a varying terry loop density in the foot portion of the sock for protecting and supplementing the fatty pads so as to provide a therapeutic and preventative benefit to the foot of the wearer, and in which the terry loops remain in a substantially upstanding position to enhance and to maintain the density of the terry loops after many wearings and launderings.

More particularly, the anatomical isotonic sock has an integrally knit leg and foot. The stretchable body yarn, preferably having a spandex core, knit throughout portions of the foot provides long-lasting, form fitting characteristics to the sock. The foot of the sock includes a relatively thick density of terry loops formed of at least three terry yarns in the ball and heel portions thereof for supplementing the fatty pads in the foot of the wearer and for providing long-lasting, form-fitting, and protective characteristics to the sock. The terry loops provide protection to the foot of the wearer from the impact and friction shearing forces that are present between the foot of the wearer and the shoe when walking, running or other similar activities. These types of friction shearing forces may cause various debilitations, such as blisters, calluses, corns, or the like which, in turn, and under extreme circumstances, can result in foot pathologies resulting in amputations.

In a preferred embodiment, a stretchable body yarn is knit throughout at least a lower portion of the foot. A second body yarn is knit in raised terry loops throughout the foot including a heel portion, an arch portion, a ball portion, a toe portion, and an instep portion. This second body yarn is knit with the stretchable first body yarn, but does not form raised terry loops in narrow longitudinal panels on either side of the foot, therein separating the terried instep portion from other terried foot portions. A first auxiliary yarn is knit to form terry loops throughout the heel portion, the ball portion, the instep portion, and the arch portion. A second auxiliary yarn is knit and chopped into and out of the sock, with the first and second body yarns and the first auxiliary yarn in only the heel portion and the ball portion, and forms thick density terry loop cushions therein. Thus, terry loop cushions of greater relative density, including three sets of terry loops, are formed in the ball and heel portions; while areas of light to moderate density terry loops, including one set of terry loops, are formed in the arch portion, the instep portion, and the toe portion; and narrow longitudinal panels, devoid of terry loops, extend along the sides of the foot separating the instep portion from the ball portion, arch portion, and heel portion to provide ventilation and reduction in fabric bulk.

The stretchable body yarn preferably comprises a spandex yarn, which is air entangled with a nylon covering yarn. The additional non-stretchable body yarn comprises two-ply 30's spun acrylic which is knit in terry loops throughout the heel portion, the arch portion, the ball portion, the toe portion, and the instep portion of the sock. The two body yarns are knit without terry loops in narrow side panels along opposite sides of the instep portion to divide an upper portion of the foot from the lower portion. Opposite ends of two of the three terry yarns of the ball and heel portions are cut adjacent said instep portion of the foot of the sock and extend around the portions of the foot of the sock in which the two terry loop yarns are knit.

A method of knitting a sock is also provided having an integrally knit leg and foot. The method includes the steps of knitting a stretchable body yarn throughout the foot of the sock, knitting an additional relatively non-stretchable body yarn to form terry loops in at least ball, heel, and arch portions of the foot of the sock, knitting a first auxiliary yarn to form terry loops in the ball and heel portions of the foot of the sock, knitting a second auxiliary yarn so as to form terry loops only in the ball and heel portions, and cutting the ends of the first and second auxiliary terry loop yarns between the ball and heel portions and an instep portion of the foot of the sock.

BRIEF DESCRIPTION OF THE DRAWINGS

Some of the features and advantages of the present invention having been stated, others will become apparent as the description proceeds when taken in conjunction with the accompanying drawings, in which.

DETAILED DESCRIPTION OF ILLUSTRATED EMBODIMENTS

Figure 1:
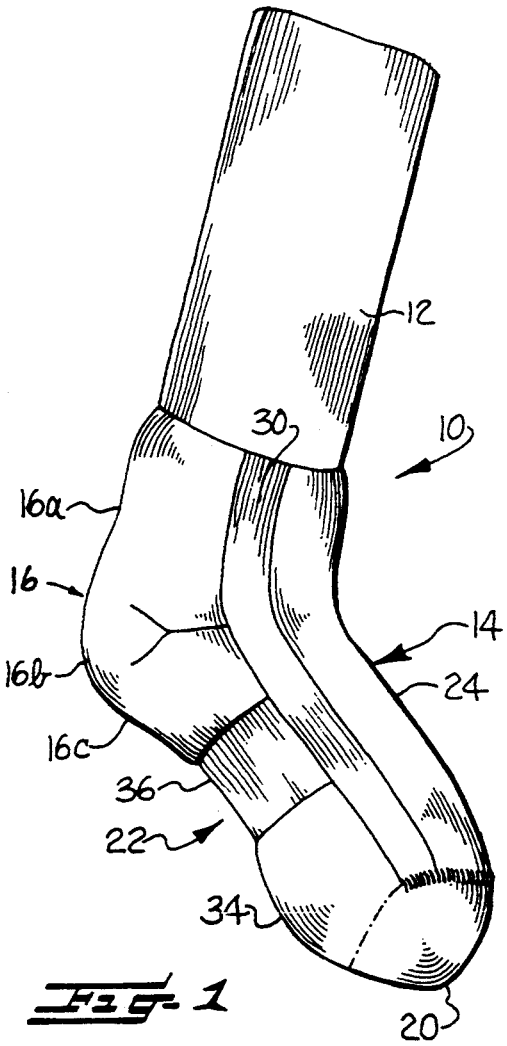
FIG. 1 is a side elevational view of the exterior of a sock according to the present invention.
Figure 2:
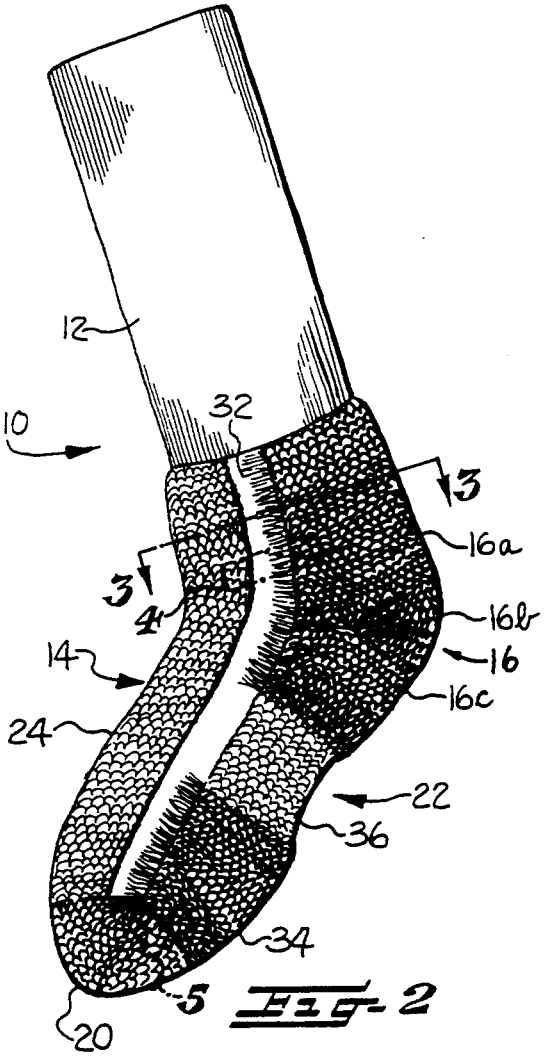
FIG. 2 is a side elevational view of a sock according to the present invention in everted condition and illustrating the positions of the raised terry loop portions of the sock.

The present invention now will be described more fully hereinafter with reference to the accompanying drawings in which illustrated embodiments of the invention are shown. This invention may, however, be embodied in many different forms and should not be construed as limited to the embodiment set forth herein; rather, these embodiments are provided so that this disclosure will be thorough and complete and will fully convey the scope of the invention to those skilled in the art. Like numbers refer to like elements throughout Referring now to the drawings, and more particularly to FIGS. 1 and 2, an anatomical, isotonic sock in accordance with the present invention is illustrated. The sock is illustrated as an athletic sock; however, the sock may be knit for use as dress socks, as well as other varieties of socks. Generally, the sock is knit similar to the sock disclosed in the commonly assigned U.S. Pat. No. 4,194,249 by Thorneburg entitled "Jogging And Running Athletic Sock", except that the sock of the present invention includes structural differences, giving the illustrated sock of the invention enhanced protection and cushioning comfort for the foot of the wearer and greater resistance to stretch and wear, to maintain the isotonic properties of the sock, and to resist elongation after prolonged wear and launderings. The sock of the present invention provides a novel structure in which the terry loops remain in a substantially upstanding position to thereby enhance and maintain the cushioning characteristics of the terry loops in the sock over prolonged periods of time and numerous launderings. Accordingly, the enhanced thickness of the terry loops are of such a degree that a normal size athletic shoe would not be able to accommodate the sock on the foot of a given wearer. Therefore, a shoe footbed or insole formed so as to receive the sock such as substantially disclosed by the commonly assigned and concurrently filed patent application entitled "Footwear System," is needed in order to allow the wearer to use his/her normal size and receive benefits from enhanced thickness of terry loops in the sock.

Throughout the description, the terms anatomical and isotonic are used. Anatomical refers to the sock shape as being shaped to the general anatomical configuration of the human foot and which includes relatively thick density, and preferably extra thick density, padding that enhances the natural fatty pads in the ball and heel of the foot so as to provide a therapeutic and preventative benefit to the foot of the wearer, and thus reducing the deteriorating effects of shearing forces on the foot of the wearer. The sock construction of the present invention provides an isotonic effect, in which impact forces exerted during wear are distributed proportionately to reduce the damaging shearing forces between the wearer's foot and the sock.

The sock 10 has an integrally knit leg and foot. The leg includes an upper cuff 12, which may be a true rib or mock rib construction. The upper cuff 12 is integrally knit with the foot, broadly indicated at 14, of the sock 10 and includes a heel portion 16 which is provided with terry loops, formed in a manner to be described. The heel portion 16 has a high splice heel region **16*a*, a medial heel region 16*b*, and a low splice heel region 16*c*. The foot 14 of the sock also includes a reciprocatorily knit toe portion 20, an integrally knit lower sole, broadly indicated at 22, and an instep portion 24**.

The lower sole 22 preferably encompasses substantially one-half the lower circumference of the foot 14, and the instep portion 24 preferably encompasses substantially one-half the circumference of the upper portion of the foot 14. As illustrated, the opposite side edges or peripheries of the instep portion 24 are knit without raised terry loops to form longitudinally extending, opposing side panels 30, 32 (FIGS. 1-3), which provide portions of reduced fabric bulk and ventilation to the foot of the wearer. The longitudinally extending side panels 30, 32 preferably extend from the toe portion 20 of the sock 10 to the leg 12 of the sock 10 in a general longitudinal direction and preferably begin at the edges of the lower sole 22 .

The lower sole 22 has a ball portion 34 positioned adjacent to the toe portion 20 and extends toward the heel portion 16 so as to include the low splice heel region **16*c*. The ball portion 34 is formed with terry loops and preferably extends not over about one-half the distance between the heel portion 16 and the toe portion 20. The lower sole 22 also includes an arch portion 36 also formed with terry loops positioned intermediate the ball portion 34 and the low splice heel region 16*c* of the heel portion 16**.

Figure 4:
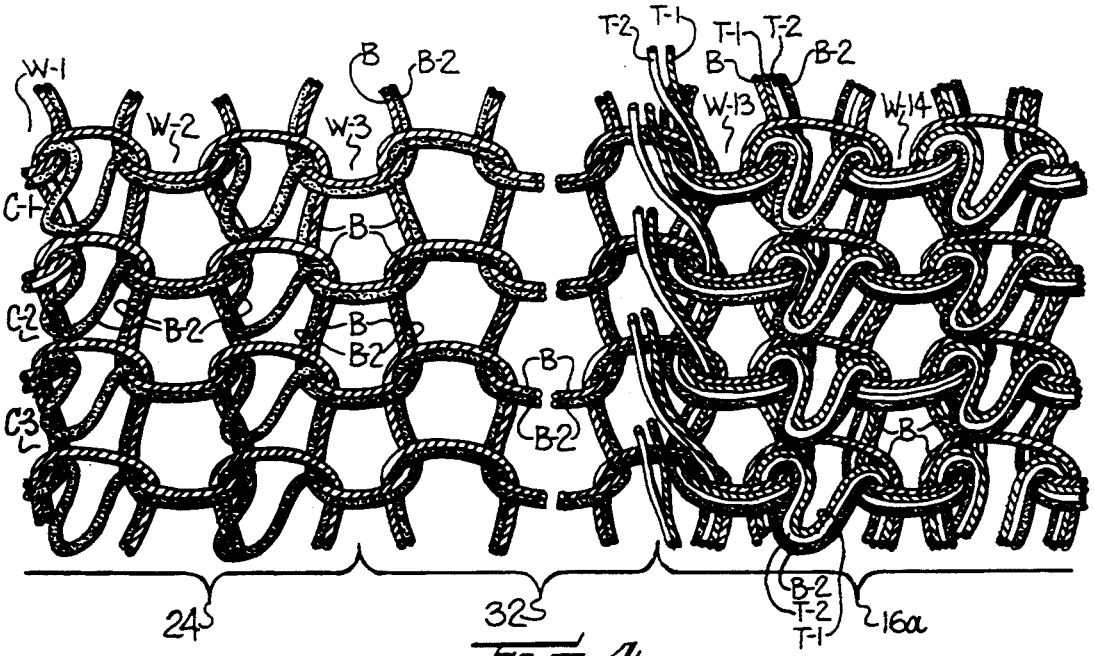
FIG. 4 is an enlarged fragmentary view of a sock according to the present invention taken substantially from rectangle 4 of FIG. 2, and having some of the wales omitted in the opposite side panels which are devoid of raised terry loops.
Figure 5:
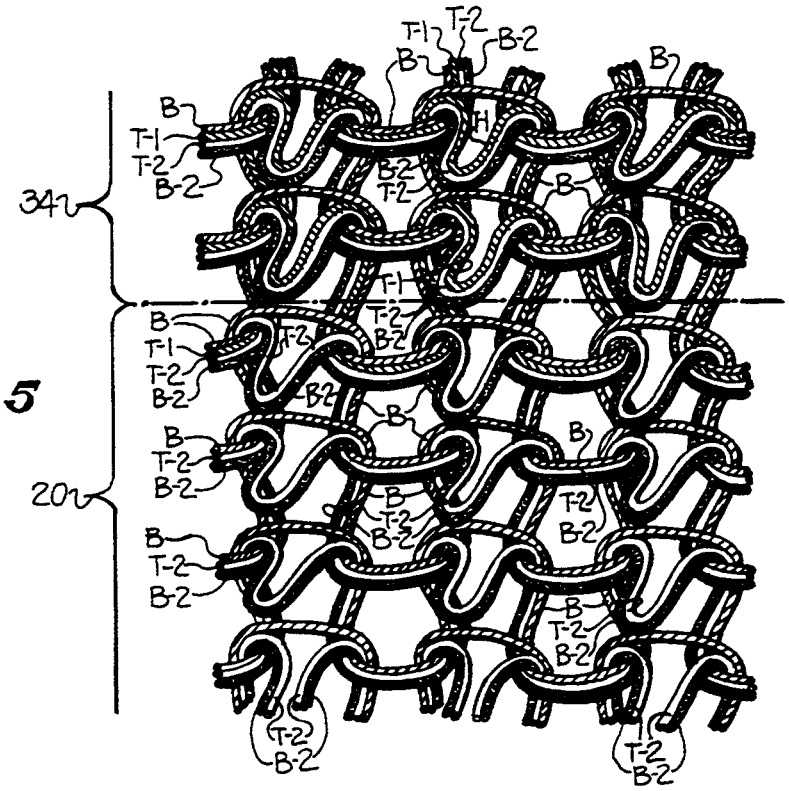
FIG. 5 is an enlarged fragmentary view of a sock according to the present invention taken substantially from rectangle 5 of FIG. 2.

The sock 10 is preferably knit throughout the foot with a stretchable body yarn indicated in FIGS. 4 and 5 at B which is illustrated with right-handed stripes for identification. The stretchable body yarn B is knit throughout at least a lower portion of the leg and foot 14 and preferably comprises a spandex core and nylon covering yarn which is air entangled with the spandex core. The spandex core and nylon covering yarn is preferably 20 denier clear Lycra. It will be apparent to those skilled in the art that other types of stretchable yarns may be used and that other types of covering yarns, such as a polyester, may also be use. An additional body or backing yarn, indicated as B2 and speckled for identification purposes, is knit with the stretchable body yarn B. The additional body yarn B2 is preferably relatively non-stretchable as compared to the stretchable body yarn B and preferably is formed of a two-ply 30's spun acrylic. The additional non-stretchable body yarn B2 forms terry loops in the high splice heel region 16a, the medial heel region 16b the low splice heel region 16c below the medial heel region 16b, the arch portion 36, the ball portion 34, the toe portion 20, and the instep portion 24. This non-stretchable body yarn B2 does not form terry loops in the region of the narrow longitudinal side panels 30, 32.

A first auxiliary terry yarn, indicated at T-1 and left-handed striped for identification, is knit with the body yarns B, B2 throughout the lower leg and the foot of the sock. The first auxiliary terry yarn T-1 also forms terry loops in the high splice heel region 16a, the medial heel region 16b, the low splice heel region 6c, the ball portion 34, and the toe portion 20. Thus, the first auxiliary terry yarn T-1 is not incorporated in the instep portion 24, the arch portion 36, or the narrow longitudinal panels 30, 32. As shown in FIG. 4, the successive courses C1, C2, C3 of the knit fabric extend in a horizontal direction and the needle wales, indicated at W-1, W-2, and W-3, et. seq., extend in a vertical direction with the sinker wales, in which the terry loops are formed, extending vertically therebetween. The number of needle wales comprising the narrow longitudinal panels 30, 32 may generally range from 4 to 14 wales depending on the needle size, the sock size, the yarn size, and/or the knit stitch size used. The preferable number of wales, however, is 7.

A second auxiliary terry yarn, indicated at T-2 and in colored for identification, is knit with the body yarns B, B2 and forms additional terry loops. The terry loops of the second auxiliary yarn T-2 is formed in the high splice heel region 16a, the medial heel region 16b, the low splice heel region 16c, and in the ball portion 34. The second auxiliary yarn T-2 preferably is introduced at the upper portion of the high splice heel region 16a, but may also be introduced at medial or lower portions thereof. The second auxiliary terry yarn T-2 is fed to the needles through a conventional "chopping" yarn feed finger, and is fed, removed, and cut adjacent the opposite sides of the lower half of knit courses adjacent the heel regions 16a, 16b, and 16c. Thus, the second auxiliary terry yarn T-2 is not incorporated in the instep portion 24, the arch portion 36, the toe portion 20, or the narrow longitudinal side panels 30, 32. During the reciprocatory knitting of the heel portion 16, and the ball portion 34, when the second terry yarn T-2 is fed to the needles through the chopping yarn feed finger, it is not necessary to feed and remove the second auxiliary terry yarn T-2 because only the needles which knit are in active position while the usual narrowing and widening operations are carried out in knitting the heel portion 16 and the ball portions 34.

Figure 3:
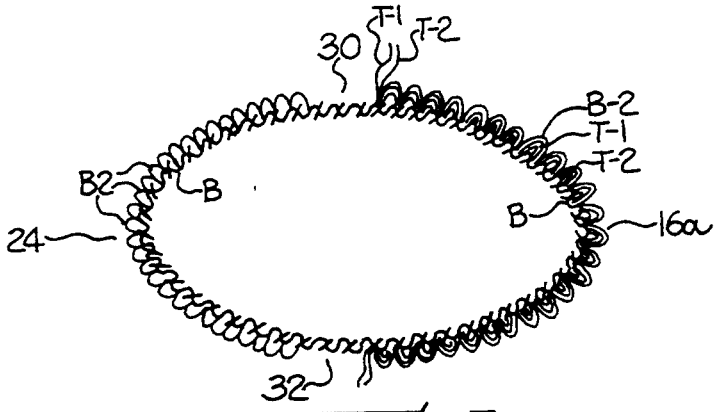
FIG. 3 is an enlarged transverse cross-sectional view of a sock according to the present invention taken along line 3-3 of FIG. 2.

In the illustrated knit fabric of FIGS. 3–5, the various yarns are shown as being substantially the same size. For purposes of clarity, the stitch structure is shown open. In the actual sock construction, the stitch loops are small, and the auxiliary terry yarns T-1, T-2 are larger and bulkier than the base yarn B. The air entangled nylon and spandex body yarn B, not forming terry loops, usually is smaller than the other body yarn B-2 and has a core of 20 denier clear Lycra.

The above described knitting forms a construction where three yarns, B2, T-1, T-2, form a relatively thick density of terry loops formed of at least three terry yarns in the ball portion 34 and heel portion 16. The third terry yarn preferably is not knit into the toe portion 20. One yarn, B2, forms a relatively thin density of terry loops in the arch portion 36 and the instep portion 24. When an attempt is made to compress the terry loops in those areas which include the more dense regions of terry loops, there are so many terry loops packed into such a small area that the formed terry loops cannot lean over and flatten as easily as in those areas where only a single yarn of terry loops is formed.

Thus, the one, two, and three terry loop yarns form terry loop cushions or shock absorbers for the wearer's feet. Further information relating to the shock absorber cushioning effect of the terry loop cushion is explained in greater detail in commonly assigned U.S. Pat. No. 4,194,249, which is hereby incorporated herein by reference.

In accordance with the present invention, the spandex-nylon entangled body yarn B provides a flexible base yarn allowing laundering and wear over prolonged time periods without flattening of the terry loops. During the normal wear and laundering, when the fabric and yarn stretches, the flexible spandex body yarn B permits stretch of the fabric, but also returns the fabric back into the normal unflexed position in which the terry loops remain substantially perpendicular and in an upstanding position to the body yarn of the sock. Thus, the density of the terry loops is maintained, moisture control in the sock continues, and the shearing forces between the sock and the foot of the wearer are not increased after many wearings and launderings. Accordingly, the enhanced thickness of the terry loops are of such a degree that a normal size athletic shoe would not be able to accommodate the sock on the foot of a given wearer. Therefore, a shoe footbed or insole formed so as to receive the sock such as substantially disclosed by the commonly assigned and concurrently filed patent application entitled "Footwear System," is needed in order to allow the wearer to use his/her normal size and receive benefits from enhanced thickness of terry loops in the sock.

Referring to FIGS. 3-5 and FIGS. 6A-6B, methods of knitting a sock 10 are also provided having a knit foot 14. One method embodiment includes the steps of knitting a stretchable body yarn B throughout the foot 14 of the sock 10, knitting an additional relatively non-stretchable body yarn B-1 to form terry loops in at least ball 34, heel 16, and arch 36 portions of the foot 14 of the sock 10, knitting a first auxiliary yarn T-1 to form terry loops in the ball 34 and heel 16 portions of the foot 14 of the sock, knitting a second auxiliary yarn T-2 so as to form terry loops only in the ball 34 and heel 16 portions, and cutting the ends of the first and second auxiliary terry loop yarns T-1, T-2 between the ball 34 and heel 16 portions and an instep portion 24 of the foot 14 of the sock 10.

A second method of knitting the sock forms a sock having varying densities of yarn in various portions of the sock. This method includes the steps of knitting a stretchable body yarn B throughout the foot 14 of the sock 10, knitting an additional relatively non-stretchable body yarn B-1 to form terry loops in at least ball 34, heel 16, and arch 36 portions of the foot 14 of the sock 10, knitting a first auxiliary yarn T-1 to form terry loops in the ball 34 and heel 16 portions of the foot 14 of the sock 10, knitting a second auxiliary yarn T-2 so as to form terry loops only in the ball 34 and heel 16 portions, the terry loops in the ball 34, heel 16, and arch 36 portions of the foot 14 of the sock 10 having a first predetermined height, knitting the first auxiliary yarn T-1 to form terry loops of a second predetermined height in an instep portion 24 of the foot 14, the second predetermined height of terry loops in the instep portion 24 being less than the first predetermined height of terry loops in the ball 34, heel 16, and arch 36 portions, and cutting the ends of the first and second auxiliary terry loop yarns T-1, T-2 between the ball 34 and heel 16 portions and an instep portion 24 of the foot 14 of the sock 10.

Figure 6A:
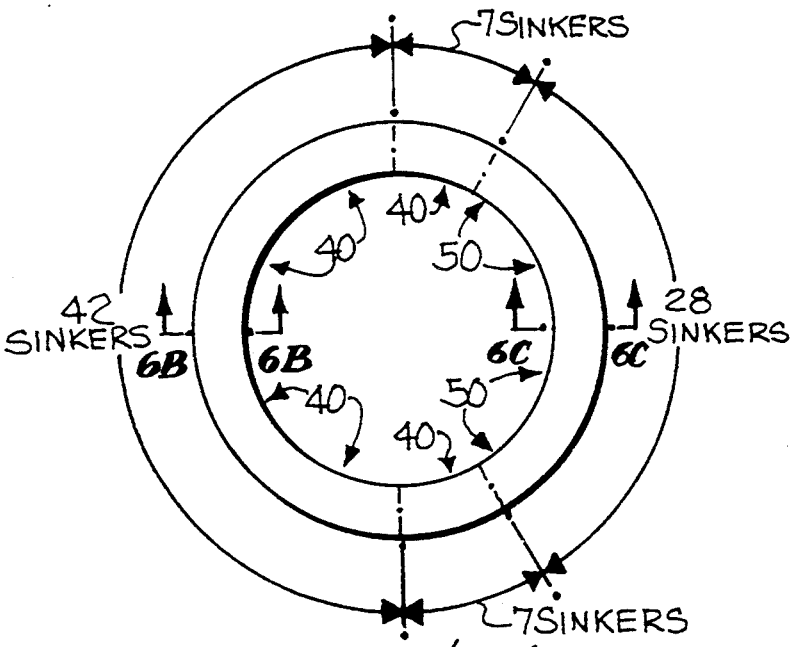
FIG. 6A is a schematic diagram of the sinkers for a circular knitting machine for knitting a sock according to the present invention.
Figure 6B:
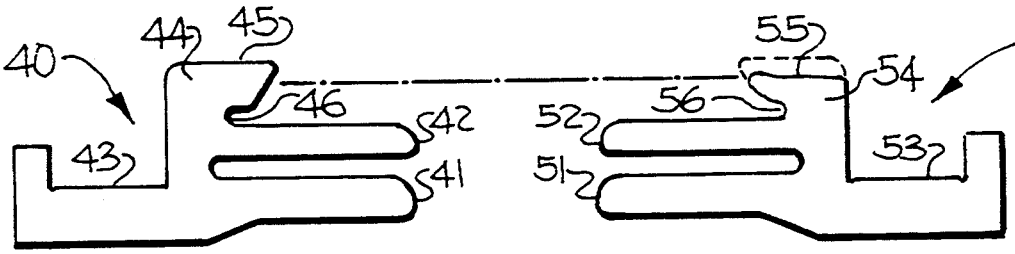
FIG. 6B is an enlarged side elevational view of a sinker having a full height neb taken along line 6B-6B of FIG. 6A for forming a sock according to the present invention.

The methods of knitting the sock 10 of the present invention are preferably performed on an 84 needle 5-inch circular knitting machine. Therefore, the machine generally has 84 sinker slots. Other machines known to those skilled in the art may also be used. As best shown in FIG. 6A, of the 84 sinker slots of the machine, 42 sinkers are preferably used to form the terry loops in the heel, arch, ball, and toe portions of the knit foot 14, and 28 sinkers are used to form the instep portion 24 of the knit foot 14. The remaining 14 sinkers are left blank to form the longitudinally extending side panels 30, 32. As will be understood by those skilled in the art, the 42 sinkers in heel, arch, ball, and toe portions of the knit foot 14 are of full height, i.e., the neb of the sinker is as high as it can go without interfering with the knitting operation of the machine. The neb of the sinkers on the machine, such as the sinker 40 shown for illustration purposes in FIG. 6B, generally has a predetermined height provided by the manufacturer. The sinker 40 has first and second knitting control ledges 41, 42 extending longitudinally outward from a butt region 43 of the sinker 40. The sinker 40 has a neb 44 also extending longitudinally outward from the butt region 43 and extending upwardly from the knitting control ledges 41, 42 and thereby forming a first predetermined height of the sinker 40. The neb 44 forms a terry ledge 45, along an upper end portion and a throat 46 of the neb 44 slopes downwardly from the terry ledge 45 toward the second knitting control ledge 42 and the butt region 43.

Figure 6C:
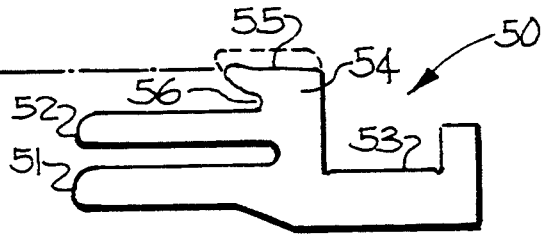
FIG. 6C is an enlarged side elevational view of a sinking having a low height neb taken along line 6C-6C for forming a sock according to the present invention.

The 28 sinkers for the instep portion 24 are cut down to a lower height, or second predetermined height, than the height of the other sinkers 50 used to knit the ball 34, heel 16, and arch 36 portions as shown for illustration purposes by sinker 50 in FIG. 6C. The neb 54 of the sinker 50 extends longitudinally outward from a butt region 53 and upwardly from first and second knitting control ledges 51, 52. The neb 54 is altered by grinding it down generally as much as possible without weakening the strength of the neb 54. By reducing the height of the neb 54, preferably in an upper end portion thereof extending upwardly from the second knitting control ledge 52 of the sinker 50. The height of the terry loop stitch formed with the sinker 50 is reduced by the reduced height of terry ledge 55. This lower height of the terry loop has the effect of reducing the density or relative bulk of the instep portion 24 of the sock 10 so that the sock 10 more easily and more comfortably fits into a shoe.

These methods of knitting the sock 10 according to the present invention may additionally include the steps of knitting the additional non-stretchable body yarn B-2 as described above to form terry loops in the toe portion 20 of the foot 14 and knitting the first auxiliary yarn T-1 to form terry loops also in the toe portion 20 of the foot 14. The method of knitting the sock 10 may further include the steps of knitting the additional non-stretchable body yarn B-2 to form terry loops in the instep portion 24 of the foot 14 of the sock 10 and knitting the additional non-stretchable body yarn B-2 without terry loops to form the longitudinally extending opposing side panels 30, 32 defining side peripheries of the instep portion 24.

In the drawings and specification, there have been disclosed typical illustrative embodiments of the present invention, and although specific terms are employed, they are used in a generic and descriptive sense only and not for purposes of limitation, the scope on the invention being set forth in the following claims.

That which is claimed is:

1. An anatomical isotonic sock for providing enhanced protection and cushioning comfort to the foot of the wearer, the sock having a knit foot and comprising a relatively thick density of terry loops forming ball and heel portions of said foot of the sock and being formed of at least three terry yarns, a relatively thin density of terry loops forming at least an arch portion of said foot of the sock and being formed of at least a single terry yarn, and a stretchable body yarn knit throughout said ball, heel, and arch portions of said foot of the sock and cooperating with said terry yarns for positioning said terry loops in a closer more compact relation so as to enhance the relative density in said terry loop portions throughout the knit sock, and wherein said at least three terry yarns are knit with the stretchable body yarn.

2. A sock according to claim 1, further comprising an intermediate density of terry loops forming a toe portion of said foot of the sock and being formed of at least two terry yarns, and said stretchable body yarn being knit throughout said toe portion.

3. A sock according to claim 1, further comprising a relatively thin density of terry loops forming an instep portion of said foot of the sock and being formed of at least a single terry yarn, and said stretchable body yarn being knit throughout said instep portion.

4. A sock according to claim 3, wherein said instep portion includes a pair of longitudinally extending knit side panels defining the opposing side peripheries of said instep portion, and wherein one of said terry yarns serves as an additional relatively non-stretchable body yarn and is knit with said stretchable body yarn to form non-terry loop portions throughout said side panels thereby reducing the bulk of the yarn forming the sock and providing ventilation to the foot of the wearer.

5. A sock according to claim 4, wherein said longitudinally extending knit side panels define opposing side peripheries of said instep portion, each of said side panels comprises at least 4 wales.

6. A sock according to claim 4, wherein said longitudinally extending knit side panels each extend from said heel portion of the sock to said toe portion of the sock.

7. A sock according to claim 3, wherein opposite ends of at least two of said three terry yarns of said ball and heel portions of said foot of the sock are cut along opposite sides of said ball and heel portions adjacent said instep portion so that said two terry yarns extend only around the portions of said foot of the sock in which said thick density terry loops are knit.

8. A sock according to claim 1, wherein said stretchable body yarn comprises a spandex yarn.

9. A sock according to claim 4, wherein said additional non-stretchable body yarn comprises an acrylic.

10. An anatomical isotonic sock for providing enhanced protection and cushioning comfort to the foot of the wearer, the sock having a knit foot and comprising a relatively thick density of terry loops forming ball and heel portions of said foot of the sock and being formed of at least three terry yarns, a relatively thin density of terry loops forming at least arch and instep portions of said foot of the sock and being formed of at least a single terry yarn, an intermediate density of terry loops forming a toe portion of the sock and being formed of two terry yarns, and a stretchable body yarn knit throughout said ball, heel, arch, and toe portions of said foot of the sock and cooperating with said terry yarns for positioning said terry loops in a closer more compact relation so as to enhance the relative density in said terry loop portions throughout the knit sock, and wherein said at least three terry yarns are knit with the stretchable body yarn.

11. A sock according to claim 10, wherein said instep portion includes a pair of longitudinally extending knit side panels defining the opposing side peripheries of said instep portion, and wherein one of said terry yarns serves as an additional relatively non-stretchable body yarn and is knit with said stretchable body yarn to form non-terry loop portions throughout said side panels thereby reducing the bulk of the yarn forming the sock and providing ventilation to the foot of the wearer.

12. A sock according to claim 11, wherein said longitudinally extending side panels define opposing side peripheries of said instep portion, each of said side panels comprises at least 4 wales.

13. A sock according to claim 11, wherein said longitudinally extending knit side panels each extend from said heel portion of the sock to said toe portion of the sock.

14. A sock according to claim 10, wherein opposite ends of at least two of said three terry yarns of said ball and heel portions of said foot of the sock are cut along opposite sides of said ball and heel portions adjacent said instep portion so that said two terry yarns extend only around the portions of said foot of the sock in which said thick density terry loops are knit.

15. A sock according to claim 10, wherein said stretchable body yarn comprises a spandex core and nylon covering yarn which is air entangled therewith.

16. A sock according to claim 11, wherein said additional non-stretchable body yarn comprises two-ply 30's spun acrylic.

17. An anatomical isotonic sock for providing enhanced protection and cushioning comfort to the foot of the wearer, the sock having a knit foot and comprising a relatively thick density of terry loops forming ball and heel portions of said foot of the sock and being formed of at least three terry yarns, a relatively thin density of terry loops forming at least arch and instep portions of said foot of the sock and being formed of at least a single terry yarn, an intermediate density of terry loops forming a toe portion of the sock and being formed of two terry yarns, and a stretchable body yarn knit throughout said ball, heel, arch, and toe portions of said foot to the sock and cooperating with said terry yarns for positioning said terry loops in a closer more compact relation so as to enhance the relative density in said terry loop portions throughout the knit sock, said instep portion of said foot of the sock including a pair of longitudinally extending knit side panels defining the opposing side peripheries of said instep portion, wherein one of said terry yarns serves as an additional relatively non-stretchable body yarn and is knit with said stretchable body yarn to form non-terry loop portions throughout said side panels, opposite ends of at least two of said three terry yarns of said ball and heel portions of said foot of the sock are cut along opposite sides of said ball and heel portions adjacent said instep portion so that said two terry yarns extend only around the portions of said foot of the sock in which said thick density terry loops are knit, and wherein the terry yarns are knit with the body yarns.

18. A sock according to claim 17, wherein said longitudinally extending side panels define opposing side peripheries of said instep portion extending from said heel portion of the sock to said toe portion of the sock, each of said side panels comprises at least 4 wales.

19. A method of knitting a sock for providing enhanced protection and cushioning comfort to the foot of the wearer, the method comprising the steps of knitting a stretchable body yarn throughout the foot of the sock, knitting an additional relatively non-stretchable body yarn to form terry loops in at least ball, heel, and arch portions of the foot of the sock, knitting a first auxiliary yarn to form terry loops in the ball and heel portions of the foot of the sock, knitting a second auxiliary yarn so as to form terry loops only in the ball and heel portions, and cutting the ends of the first and second auxiliary terry loop yarns between the ball and heel portions and an instep portion of the foot of the sock.

20. A method of knitting a sock according to claim 19, further comprising the steps of knitting the additional non-stretchable body yarn to form terry loops in a toe portion of the foot and knitting the first auxiliary yarn to form terry loops in the toe portion of the foot.

21. A method of knitting a sock according to claim 19, further comprising the steps of knitting the additional non-stretchable body yarn to form terry loops in an instep portion of the foot of the sock.

22. A method of knitting a sock according to claim 21, further comprising the step of knitting the additional non-stretchable body yarn without terry loops to form longitudinally extending opposing side panels defining side peripheries of the instep portion.

23. A method of knitting a sock for providing enhanced protection and cushioning comfort to the foot of the wearer, the method comprising the steps of knitting a stretchable body yarn throughout the foot of the sock, knitting an additional relatively non-stretchable body yarn to form terry loops in at least ball, heel, and arch portions of the foot of the sock, knitting a first auxiliary yarn to form terry loops in the ball and heel portions of the foot of the sock, knitting a second auxiliary yarn so as to form terry loops in the ball and heel portions, the terry loops in the ball, heel, and arch portions having a first predetermined height, and knitting the first auxiliary yarn to form terry loops of a second predetermined height in an instep portion of the foot, the second predetermined height of terry loops in the instep portion being less than the first predetermined height in the ball, heel, and arch portions.

24. The method according to claim 23, further comprising the step of cutting the ends of the first and second auxiliary terry loop yarns between the ball and heel portions and the instep portion of the foot of the sock.

25. A method of knitting a sock according to claim 23, further comprising the step of knitting the additional non-stretchable body yarn without terry loops to form longitudinally extending opposing side panels defining side peripheries of the instep portion.

* * * * *

UNITED STATES PATENT AND TRADEMARK OFFICE

CERTIFICATE OF CORRECTION

PATENT NO. : 5,335,517

DATED : August 9, 1994

INVENTOR(S) : Throneburg et al.

It is certified that error appears in the above-identified patent and that said Letters Patent is hereby corrected as shown below:

In Column 5, line 29, delete "in".

Col. 5, line 30, change "colored" to --uncolored--

Signed and Sealed this

Eighth Day of November, 1994

Bruce Lehman

*Attest:*

BRUCE LEHMAN

*Attesting Officer*

*Commissioner of Patents and Trademarks*